United States Patent [19]

Searle

[11] Patent Number: 4,979,451

[45] Date of Patent: Dec. 25, 1990

[54] UNDER WATER AIR LIFT UTILITY BAG

[75] Inventor: LeRoy D. Searle, 7344 Sunhill Rd., Salt Lake City, Utah 84121

[73] Assignee: LeRoy Searle, Salt Lake City, Utah

[21] Appl. No.: 397,275

[22] Filed: Aug. 23, 1989

[51] Int. Cl.[5] ..... B63C 7/00

[52] U.S. Cl. ..... 114/54; 114/50

[58] Field of Search ..... 114/315, 50–54, 114/326; 441/6, 21, 30, 32

[56] References Cited

U.S. PATENT DOCUMENTS

| | | | |
|---|---|---|---|
| 2,892,434 | 6/1959 | Ralleo et al. | 114/54 |
| 3,316,872 | 5/1967 | Van Eck | 114/54 |
| 4,092,756 | 6/1978 | Stier | 441/30 |
| 4,510,878 | 4/1985 | Breedlove | 114/54 |

*Primary Examiner*—Joseph F. Peters, Jr.
*Assistant Examiner*—Edwin L. Swinehart

[57] ABSTRACT

In a lift device used by divers to bring objects from the bottom to the top of a body of water, this invention eliminates the need for a second bag. This is accomplished by combining the lifting and the carrying bag into one unit. The bags are combined in such a manner as to allow easy upright top loading, and to allow the bag to float while loading. It also allows for easy loading and dumping. The strapping devise connecting the bags at the bottom keeps the bags in a relative position to each other allowing the unit to float upright at any level, whether on the bottom or the surface of the water.

4 Claims, 1 Drawing Sheet

UNDER WATER AIR LIFT UTILITY BAG

FIELD OF THE INVENTION

When it is necessary for divers to have a means of lifting objects from the bottom to the surface of lakes or other bodies of water, time is important, and quick access to the lifting devise is desirable. This invention is in the field of lifting devises that will enable the diver to make better use of his time and accomplish more work.

DESCRIPTION OF THE PRIOR ART

The usual method of lifting is to have an inverted bag that can be partially filled with air, causing it to float to the surface. Some of these bags have a means of adjusting the amount of lift by controlling the amount of air in the bag. These lifting devises also require some other kind of bag or container to hold the objects to be lifted. They also require a means of attaching the container to the lifting devise. This means that the diver must take two bags or containers down with him, one for lifting, and one to contain the load of objects collected.

SUMMARY OF THE INVENTION

In my invention, there are two bags combined into a single unit. The inner bag is for holding the collected objects, and the outer bag is the flotation bag. The outer flotation bag would be filled with air from the divers tank or some other source of air or gas. The inner bag is open at the top with the capability of being fastened shut. The outer bag fits over the inner bag like a sleeve, and the two are sealed together at the top.

The bags are constructed from flexible material capable of holding air or gas. The flexible material will allow the unit to be rolled or folded into a compact form for easy handling. The outer bag is open at the bottom and does not extend to the bottom of the inner bag. The outer bag is equipped with straps or ropes that are attached to the bottom edge and circle under the inner bag to the opposite side of the outer bag. The straps are also attached to the bottom of the inner bag. These straps serve to keep the two bags in the proper position to each other, and also as a means of attaching other objects that are too large or cumbersome to be put into the bag. The outer bag also has the option of being equipped with a devise to control the amount of air in the bag, thus controlling the speed at which the bags will rise, or the level of buoyancy.

DETAILED DESCRIPTION OF THE DRAWINGS

Figure 1:
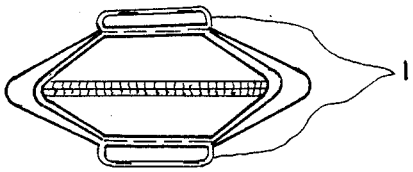
FIG. 1 A view from the top with the bag open.
Figure 2:
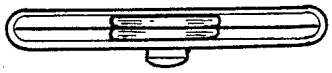
FIG. 2 A view from the top with bag closed.
Figure 3:
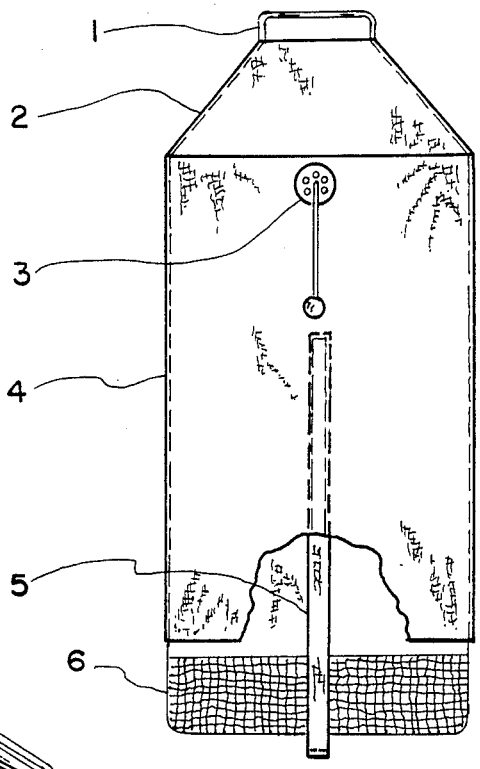
FIG. 3 A view from the front.
Figure 4:
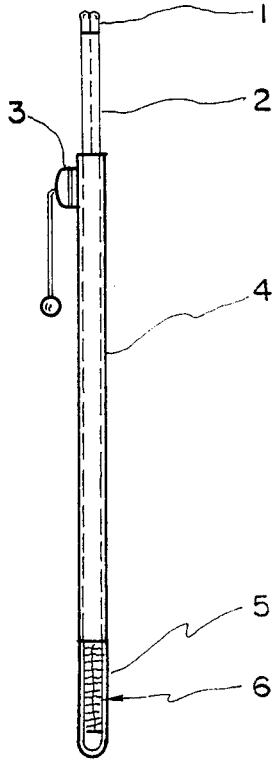
FIG. 4 A view from the side.
Figure 5:
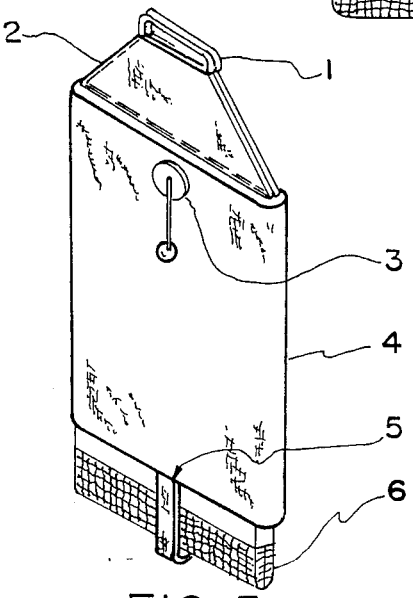
FIG. 5 A diagonal view showing front and side with the top opening of the inner bag closed.
Figure 6:
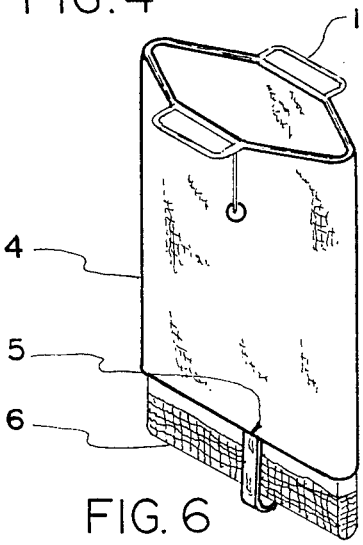
FIG. 6 A diagonal view showing front and side with the top opening of the inner bag open.

The present invention of a lifting device includes an inner bag 2 and outer bag 4 which are constructed of water impervious material. The bags are sealed together at the top of the outer bag, while the inner bag 2 provides handles 1 at the top thereof.

Objects to be lifted are placed through the open top of the inner bag 2. A mesh fabric 6 is provided at the bottom of the inner bag 2 to provide for drainage, and a support strap 5, attached at the bottom of the outer bag helps to maintain the bags in the proper position, and provides an attachment point for objects which are too big to be placed within the inner bag 2.

The outer bag 4 may be provided with a buoyancy control valve 3 to control the speed at which the lift device will rise to the surface.

I claim:

1. A device for lifting objects to the surface of a body of water, comprising;

A first inner sleeve formed of a gas impervious material, and having an upper end A second outer sleeve formed of a gas impervious material, and having a upper end, and surrounding said inner sleeve, said upper ends being sealed together to form a compartment between said inner and outer sleeves adapted to be filled with air to render said device buoyant, A compartment formed within said inner sleeve for receiving said objects to be lifted.

2. A device for lifting objects to the surface of a body of water as defined in claim 1 comprising;

said inner sleeve having a bottom end formed of mesh fabric, so as to be self draining.

3. A device for lifting objects to the surface of a body of water as defined in claim 1, comprising;

A handle means formed at the upper end of said inner sleeve.

4. A device for lifting objects to the surface of a body of water as defined in claim 1, comprising;

a support strap extending below said sleeves

* * * * *